US011178908B2

(12) United States Patent
Qiu

(10) Patent No.: US 11,178,908 B2
(45) Date of Patent: Nov. 23, 2021

(54) ATOMIZER AND ELECTRONIC CIGARETTE THEREOF

(71) Applicant: CHANGZHOU JWEI INTELLIGENT TECHNOLOGY CO., LTD., Jiangsu (CN)

(72) Inventor: Weihua Qiu, Jiangsu (CN)

(73) Assignee: CHANGZHOU JWEI INTELLIGENT TECHNOLOGY CO., LTD., Jiangsu (CN)

( * ) Notice: Subject to any disclaimer, the term of this patent is extended or adjusted under 35 U.S.C. 154(b) by 412 days.

(21) Appl. No.: 16/234,466

(22) Filed: Dec. 27, 2018

(65) Prior Publication Data

US 2019/0124997 A1 May 2, 2019

Related U.S. Application Data

(63) Continuation of application No. PCT/CN2017/088396, filed on Jun. 15, 2017.

(30) Foreign Application Priority Data

Jun. 28, 2016 (CN) ..... 201610484111.3
Jun. 28, 2016 (CN) ..... 201620654095.3

(51) Int. Cl.

| | |
|---|---|
| ***A24F 13/00*** | (2006.01) |
| ***A24F 7/00*** | (2006.01) |
| ***A24F 40/485*** | (2020.01) |
| *A24F 15/015* | (2020.01) |
| *A24F 40/10* | (2020.01) |

(52) U.S. Cl.
CPC ..... *A24F 7/00* (2013.01); *A24F 40/485* (2020.01); *A24F 15/015* (2020.01); *A24F 40/10* (2020.01)

(58) Field of Classification Search
CPC ..... A24F 47/00
USPC ..... 131/328–329
See application file for complete search history.

(56) References Cited

U.S. PATENT DOCUMENTS

2020/0069894 A1* 3/2020 Qiu ..... A61M 11/042

FOREIGN PATENT DOCUMENTS

| | | | |
|---|---|---|---|
| CN | 203952433 | U | 11/2014 |
| CN | 204351070 | U | 5/2015 |
| CN | 204444248 | U | 7/2015 |
| CN | 104939326 | A | 9/2015 |
| CN | 205161898 | U | 4/2016 |
| CN | 105559151 | A | 5/2016 |
| CN | 205284992 | U | 6/2016 |
| CN | 205284994 | U | 6/2016 |
| CN | 106072768 | A | 11/2016 |
| CN | 205757209 | U | 12/2016 |
| CN | 205757210 | U | 12/2016 |
| GB | 2515562 | A | 12/2014 |

* cited by examiner

*Primary Examiner* — Phuong K Dinh
(74) *Attorney, Agent, or Firm* — Novick, Kim & Lee, PLLC; Allen Xue

(57) ABSTRACT

An atomizer changes the inflow and outflow direction by adding a shunt tube. The external air passes through the bottom of the atomizing chamber to the top of the atomizing chamber, carrying out the smoke in the atomizing chamber. In another atomizer, the air outlet pipe extends directly to the bottom of the atomizing chamber, where it is connected to the air inlet passage in the air intake member. As such, the smoke in the atomizing chamber can be carried out by the external air.

20 Claims, 14 Drawing Sheets

ATOMIZER AND ELECTRONIC CIGARETTE THEREOF

CROSS-REFERENCE TO RELATED APPLICATIONS

This application is a continuation of International Patent Application No. PCT/CN2017/088396, filed on Jun. 15, 2017, entitled "atomizer and electronic cigarette thereof", which claims priority to Chinese Patent Application No. 201620654095.3, filed on Jun. 28, 2016, entitled "atomizer and electronic cigarette thereof" and Chinese Patent Application No. 2016/10484111.3, filed on Jun. 28, 2016, entitled "atomizer and electronic cigarette thereof". All of the aforementioned patent applications are hereby incorporated by reference in their entireties.

FIELD

The present disclosure relates to an electronic cigarette technical field, and particularly relates to an atomizer and an electronic cigarette using the same.

BACKGROUND

In the market, some of the electronic cigarettes adopt the upper air intake mode, the air intake passage and the air outlet passage of the electronic cigarette only extend to the top of the atomizing chamber. That is, the air intake passage and the air outlet passage are connected to the top of the atomizing chamber of the electronic cigarette. Therefore, during use, the external air passes through the air intake passage to the top of the atomizing chamber and is mixed with the smoke at the top of the atomizing chamber. After the atomizer is stopped using, the smoke received in the bottom of the atomizing head, which has not been taken away out of the bottom of the atomizing head by the external air, is cooled to a liquid state, so that effusion is formed at the bottom of the atomizing head. When the user uses the cigarette again, it will emit a "gurgles" sound, and there is a risk that the user will suck the cigarette liquid into the mouth. On the other hand, the external air only reaches the top of the atomizing chamber; the bottom of the atomizing chamber cannot be cooled by the external air. Therefore, the temperature at the bottom of the atomizing chamber is higher the top of the atomizing chamber. After the atomizer is stopped using, the temperature at the bottom of the atomizing chamber will drop sharply which leads the pressure at the bottom of the atomizing chamber to drop sharply, causing the liquid smoke on the liquid guiding member to penetrate to the bottom of the atomizing chamber to form effusion.

SUMMARY

In view of at least one of the above technical problems, an object of the present disclosure provides an atomizer, and an electronic cigarette.

An atomizer includes an inlet and outlet assembly, and an atomizing head provided with an atomizing chamber, the inlet and outlet assembly includes a shunt tube and an air intake pip, the shunt tube is provided with an air intake groove and an air outlet groove isolated from the air intake groove; one end of the air intake pipe is connected to the shunt tube, the opposite end of the air intake pipe extends through the air adjusting inner ring in the axial direction of the atomizing head to the bottom of the atomizing chamber, the air intake pipe is provided with an air intake pipe in communication with the air intake groove and the bottom of the atomizing chamber; the gap between the inner cavity wall of the atomizing chamber and the air intake pipe form an air outlet passage which is in communication with the bottom of the atomizing chamber and the air outlet groove.

In one embodiment, the atomizer further comprises air regulating assembly, the air regulating assembly includes an air adjusting inner ring and an air adjusting outer ring, one end of the air adjusting inner ring is sleeved on the outer circumference of the mouthpiece connector, the opposite end of the air adjusting inner ring is connected to the atomizing head, the air adjusting inner ring is provided with an air inlet in communication with the air adjusting groove, the air adjusting outer ring is rotatably sleeved outside of the air adjusting inner ring, the inner wall of the air adjusting outer ring is provided with an air adjusting groove in communication with the outside, rotating the air adjusting outer ring can make the air adjusting groove in communication with or staggered from the air inlet.

In one embodiment, the shunt tube includes a splitting portion extending radially along the atomizer and a connecting portion extending axially along the atomizer, the splitting portion is located in the regulating inner ring, the connecting member extends through the bottom of the splitting portion to connect with the top portion of the splitting portion, the air intake groove extends through the splitting portion and the connecting member along the radial direction of the atomizer, the air inlet extends through the splitting portion and the connecting member along the axially direction of the atomizer, the air outlet groove is disposed between the bottom portion and the top portion of the splitting portion along the axial direction of the atomizer.

In one embodiment, one end of the air intake pipe is connected to the connecting member, the opposite end of the air intake pipe extends through the air adjusting inner ring along the atomizing head to the bottom of the atomizing chamber, the air outlet passage further comprise gap located between the air adjusting inner ring and the air intake pipe.

In one embodiment, the shunt tube includes a splitting portion extending radially along the atomizer and a connecting portion extending axially along the atomizer, the air intake groove extends through the opposite ends of the splitting portion, the connecting member comprise a first connecting portion and a second connecting portion sleeved outside of the first connecting portion, the first connecting portion extends through the bottom of the splitting portion and is in communication with the air intake groove, the air outlet groove extends through the bottom and the top of the splitting portion in the axial direction of the atomizer, the air outlet groove is located between the first connecting portion and the second connecting portion.

In one embodiment, one end of the air intake pipe is connected to the shunt tube, the opposite end of the air intake pipe extends through the second connecting portion and to the bottom of the atomizing chamber in the axial direction of the atomizing head, the atomizing head is connected to the second connecting portion.

In one embodiment, the side edge of the splitting portion is provided with a sealing groove along the circumferential direction thereof.

In one embodiment, the liquid storage assembly includes a liquid storage tube for storing cigarette liquid; the atomizing head base is received in the liquid storage tube, the atomizing head includes an atomizing head base, an atomizing assembly, and an atomizing head sleeve, the atomizing head sleeve is sleeved on the atomizing head base, the atomizing assembly is located on the atomizing head base and received in the atomizing head sleeve.

In one embodiment, the atomizing assembly includes a liquid guiding member and a heating member, the liquid guiding member is disposed on the atomizing head base and housed in the atomizing head sleeve, the liquid guiding member passes through the opposite ends thereof to form an atomizing chamber, the atomizing head base is provided with a liquid inlet groove in communication with the liquid storage tube and the liquid guiding member, or, the atomizing head sleeve is provided with a liquid inlet hole in communication with the liquid storage tube and the liquid guiding member, the heating member adheres to the wall of the atomizing chamber.

In one embodiment, the liquid storage assembly includes an atomizer base and a first electrode is disposed on the atomizer base, a second electrode is disposed on the atomizing head base, the first electrode and the second electrode are electrically connected each other.

An electronic cigarette, comprising any one of the above atomizer.

An atomizer, includes an atomizing head provided with an atomizing chamber, and an inlet and outlet assembly, the inlet and outlet assembly includes an air intake member and an air outlet pipe, one end of the air intake member is connected to the atomizing head, an air intake passage in communication with the atomizing chamber is disposed air intake member, the opposite end of the air intake member away from the atomizing head defines an air intake hole in communication with the air intake passage, the bottom end of the air outlet pipe is directly extended through the air intake passage to the bottom of the atomizing chamber, the air outlet pipe defines a outlet passage, the air outlet passage is in communication with the air intake passage at the bottom of the atomizing chamber.

In one embodiment, mouthpiece assembly includes a mouthpiece connector, one end of the air outlet pipe away from the bottom of the atomizing chamber is connected with the mouthpiece connector, the air intake inner ring is sleeved on the outer circumference of the mouthpiece connector; the air intake passage is formed by the gap between the air intake member and the mouthpiece connector, and the gap between the air intake member and the air outlet pipe.

In one embodiment, the air intake member includes an air intake inner ring, the air intake hole is defined at one end of the air intake inner ring, one end of the air intake inner ring away from the air intake hole is connected to the atomizing head.

In one embodiment, the air intake member includes an air intake inner ring and a connecting pipe, the air intake hole is defined at one end of the air intake inner ring, one end of the connecting pipe is connected between one end of the air intake inner ring away from the air intake hole and the atomizing head.

In one embodiment, the air intake member further includes an air adjusting outer ring, the air adjusting outer ring is rotatably sleeved outside of the air intake inner ring and has an air adjusting groove defined on its inner wall, the air adjusting groove is capable communication with or staggered from the outside.

In one embodiment, the air adjusting groove 3361 extends along the axial direction of the air adjusting outer ring 336 to the bottom edge thereof and is in communication with the outside.

In one embodiment, the atomizer further includes an atomizing assembly, the atomizing assembly includes a liquid guiding member and a heating member, the opposite ends of the liquid guiding member extends the axial direction of the liquid guiding member to form an atomizing chamber, the heating member adheres to the wall of the atomizing chamber.

In one embodiment, the atomizer further includes a liquid storage assembly, the liquid storage assembly includes a liquid storage tube for storing the cigarette liquid, the atomizing head further includes an atomizing head base and an atomizing head sleeve, the atomizing head base is received in the liquid storage tube, the atomizing head sleeve is sleeved on the atomizing head base and connected to one end of the air intake member, the liquid guiding member and the heating member are received in the atomizing head sleeve, the atomizing head base is provided with a liquid inlet groove in communication with the liquid storage tube and the liquid guiding member.

In one embodiment, the liquid storage assembly further includes a liquid injection outer ring, a liquid injection inner ring and a connection seat and a connection seat, the liquid injection inner ring is rotatably sleeved out of the liquid injection inner ring, the connection seat is connected between the liquid injection inner ring and liquid storage tube, the liquid injection inner ring defines a first injection hole in communication with the inner chamber of the liquid storage tube, the liquid injection outer ring defines a second injection hole which is capable in communication with or staggered from the first injection hole.

An electronic cigarette includes any one of the above atomizer.

The beneficial effects of the device are:

In one of the disclosure, the atomizer changes the inflow and outflow direction by adding a shunt tube, since the external air flows through the bottom of the atomizing chamber and then flows to the top of the atomizing chamber, the smoke in the atomizing chamber can be mixed with and carried out by the air, thereby effectively avoid the formation of effusion formed by smoke being cooled, after the atomizer is stopped. On the other hand, the external air is directly passed through the bottom of the atomizing chamber, the bottom of the atomizing chamber can be cooled to reduce the temperature difference between the top and the bottom of the atomizing head. Thus, the following phenomenon can be avoided, when the atomizing head is stopped using, the temperature of the bottom of the atomizing head is too higher than the temperature of the bottom of the atomizing head, the rapid cooling will make the pressure at the bottom of the atomizing chamber suddenly reduced, thereby the cigarette liquid absorbed on the liquid guiding member penetrates to the bottom of the atomizing chamber to form effusion.

In the other disclosure, the air outlet pipe of the atomizer extends directly to the bottom of the atomizing chamber, the air inlet passage formed between the air intake member, the mouthpiece connector and the air outlet pipe is in communication with the air outlet passage of the air outlet pipe at the bottom of the atomizing chamber. Such that the external air flowed into the atomizing chamber via the air intake member must pass through the bottom portion of the atomizing chamber before flowing out of the air outlet pipe. Thereby, the smoke at the top of the atomizing chamber or at the bottom of the atomizing chamber can be mixed with the external air and taken out by the external air, which can effectively prevent the smoke at the bottom of the atomizing chamber, which didn't carried out by the external air, forming effusion caused by cooling after the atomizer is stopped.

Figure 1:
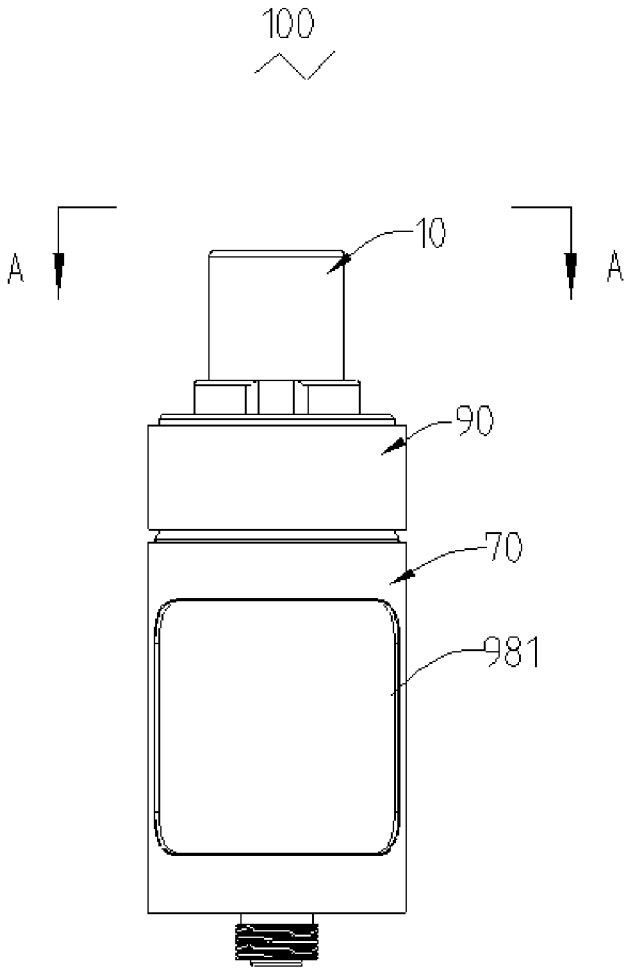
FIG. 1 is a schematic structural view of an atomizer according to a first embodiment of the present disclosure.

The following table list various components and reference numerals thereof.

| | |
|---|---|
| Atomizer 100, 200, 300 | Mouthpiece assembly 10 |
| Mouthpiece 11 | Mouthpiece connector 13 |
| Inlet and outlet assembly 30 | Shunt tube 31 |
| Air intake pipe 32 | Air intake member 33 |
| Air outlet pipe 34 | Air regulating ring 35 |
| Air intake groove 310 | Air outlet groove 312 |
| Splitting portion 314 | Connecting member 316 |
| Air intake passage 321, 330 | Air Outlet passage 323, 340 |
| Air intake inner ring 332 | Connecting pipe 334 |
| Air adjusting outer ring 336 | Air vent 351 |
| Sealing groove 3141 | Air intake hole 3321 |
| Air adjusting groove 3361 | Socket portion 3142 |
| First connection portion 3161 | Second connecting portion 3162 |
| Atomizing head 50 | Atomizing head base 51 |
| Atomizing assembly 52 | Atomizing head sleeve 53 |
| Second electrode 54 | Second sealing member 55 |
| Liquid guiding member 521 | Heating element 523 |
| Liquid inlet groove 510 | Second through hole 512 |
| Liquid inlet hole 531 | Liquid storage assembly 70 |
| Liquid storage tube 71 | Liquid injection inner ring 72 |
| Liquid injection outer ring 73 | Connection seat 74 |
| Atomizer base 75 | First electrode 76 |
| First sealing member 77 | First electrode contact sleeve 78 |
| First silicone gasket 79 | Reservoir chamber 710 |
| First liquid injection hole 721 | Second liquid injection hole 730 |
| First through hole 750 | Air regulating assembly 90 |
| Air adjusting inner ring 91 | Air adjusting outer ring 93 |
| Air intake hole 910 | Air adjusting groove 930 |
| Protective sleeve 98 | Window 981 |
| Atomizing chamber 5210 | Third sealing member 92 |

DETAILED DESCRIPTION OF PREFERRED EMBODIMENTS

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

When a feature or element is herein referred to as being "on" another feature or element, it can be directly on the other feature or element or intervening features and/or elements may also be present.

Terminology used herein is for the purpose of describing particular embodiments only and is not intended to be limiting of the disclosure. As used herein, the term "and/or" includes any and all combinations of one or more of the associated listed items and may be abbreviated as "/".

The First Embodiment

Figure 2:
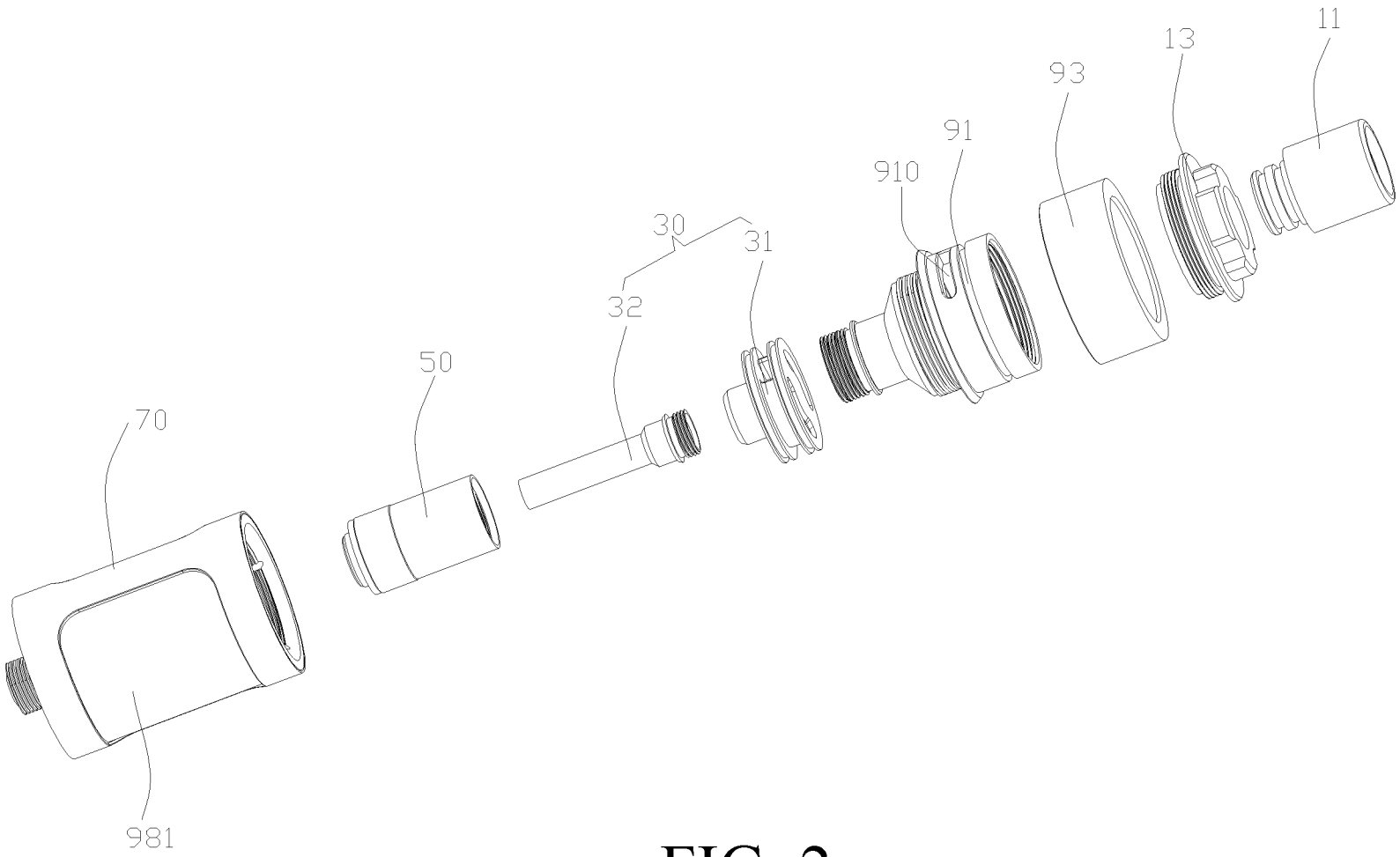
FIG. 2 is an exploded perspective view of the atomizer of FIG. 1.
Figure 3:
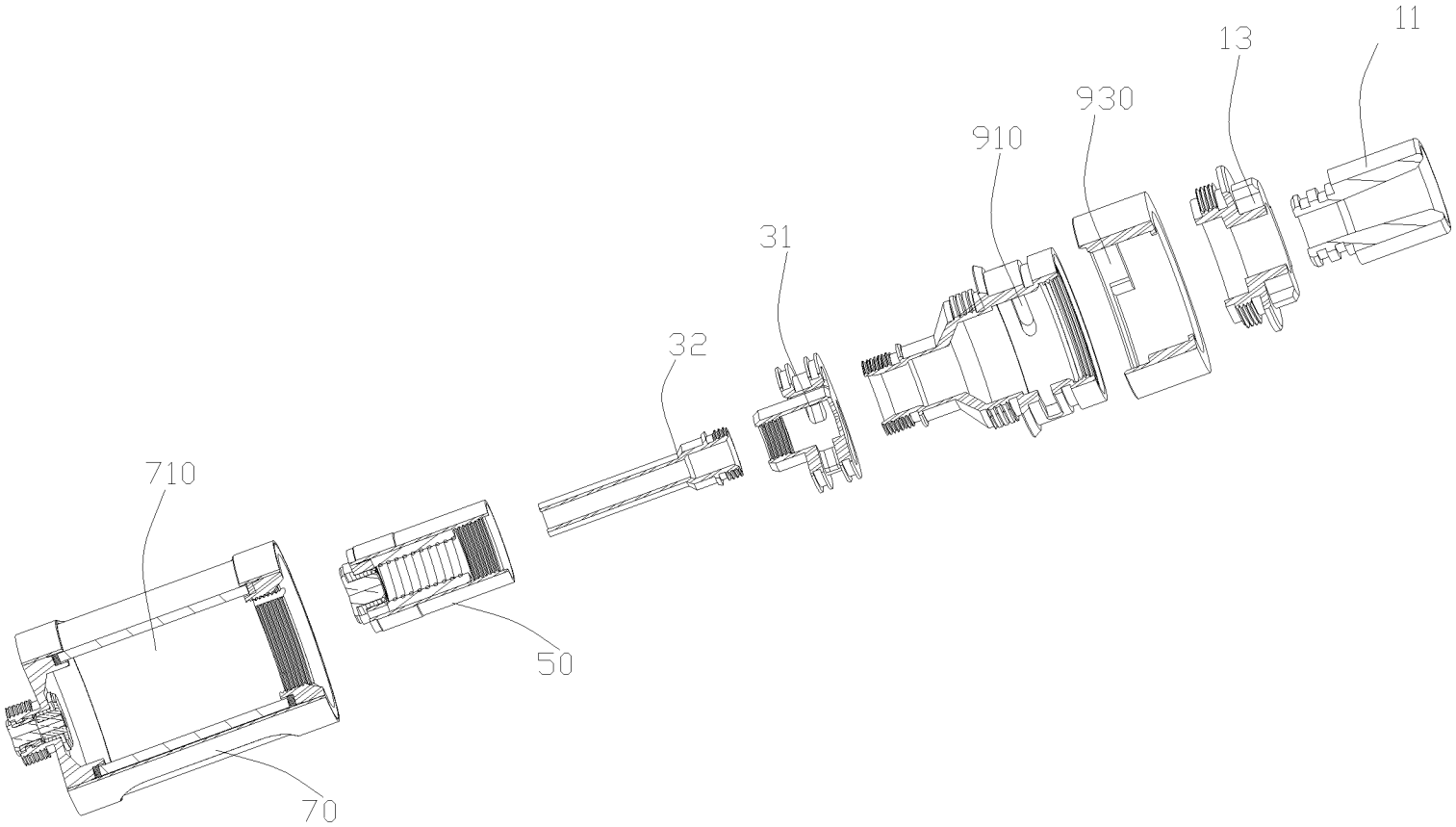
FIG. 3 is a cross-sectional view of the atomizer of FIG. 2 taken along the axial direction.
Figure 4:
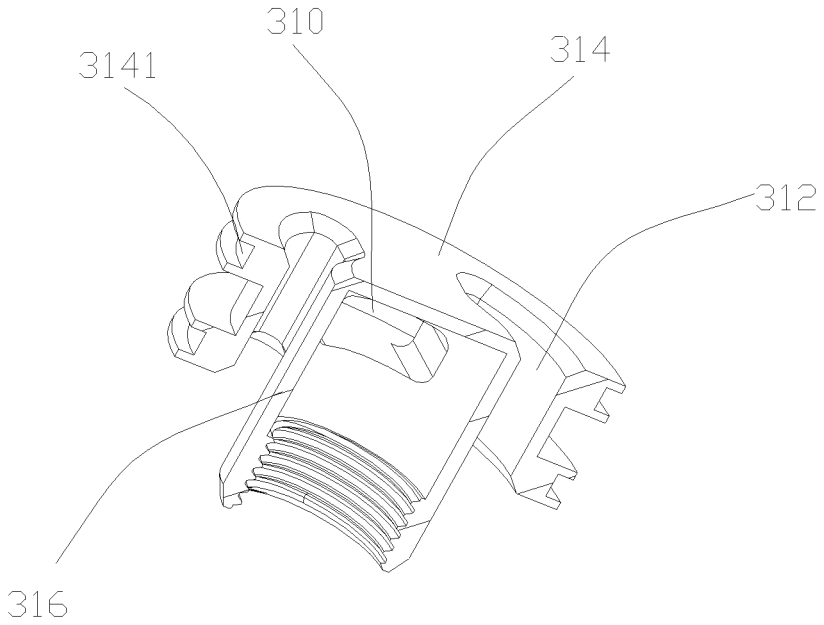
FIG. 4 is a cross-sectional view of the shunt tube shown in FIG. 3 taken along the axial direction.

Referring to FIGS. 1, 2 and 3, a first embodiment of the present disclosure provides an electronic cigarette, the electronic cigarette includes an atomizer 100, and a battery assembly (not shown) electrically connected the atomizer 100. Atomizer 100 includes a mouthpiece assembly 10, an inlet and outlet assembly 30, an atomizing head 50 provided with an atomizing chamber 5210, a liquid storage assembly 70 provided with a liquid a reservoir chamber 710, and an air regulating assembly 90. The air regulating assembly 90 is connected between the mouthpiece assembly 10 and the liquid storage assembly 70. The atomizing head 50 is received in the liquid storage assembly 70 and is located at the bottom of the reservoir chamber 710. One end of the inlet and outlet assembly 30 is housed in the air regulating assembly 90, the opposite end of the inlet and outlet assembly 30 extends into the atomizing chamber 5210. In use, the external air passes through the air regulating assembly 90, inlet and outlet assembly 30 successively and flows into atomizing chamber 5210, and fully mixed with the smoke formed by the atomizer 100, and then flows out of the mouthpiece assembly 10 and is sucked into the mouth of the user under the suction of the user.

Referring to FIG. 2 and FIG. 3, the mouthpiece assembly 10 includes a mouthpiece connector 13 and a mouthpiece 11 disposed on the top of the mouthpiece connector 13 for the user to smoke. The air regulating assembly 90 includes an air adjusting inner ring 91 and an air adjusting outer ring 93. One end of the air adjusting inner ring 91 is sleeved on the outer circumference of the mouthpiece connector 13, and the opposite end of the air adjusting inner ring 91 is received in the liquid storage assembly 70 and connected to the atomizing head 50. The air adjusting inner ring 91 has an air intake hole 910, which is positioned between the mouthpiece connector 13 and the liquid storage assembly 70. The air adjusting outer ring 93 is rotatably sleeved outside of the air adjusting inner ring 91. The inner wall of the air adjusting outer ring 93 is provided with an air adjusting groove 930, the air adjusting groove 930 extends along the axial direction of the air adjusting outer ring 93 to the bottom thereof and is in commutation with the outside.

When the air adjusting outer ring 93 is rotated to make the air adjusting groove 930 in communication with the air intake hole 910, a gap is formed between the air adjusting groove 930 and the air intake hole 910 for the external air to enter, thereby the user can adjust the air intake as needed. When the air adjusting outer ring 93 is rotated to make the air adjusting groove 930 and the air intake hole 910 staggered, the gap between the air adjusting groove 930 and the air intake hole 910 is closed to prevent external air from entering. In addition, since the air adjusting groove 930 is defined on the inner wall of the air adjusting outer ring 93, the possibility that the air adjusting groove 930 is contaminated by the outside can be reduced, and the appearance is beautiful.

Referring to FIGS. 3-6, the inlet and outlet assembly 30 includes a shunt tube 31 and an air intake pipe 32. The air adjusting inner ring 91 is sleeved on the outer circumference of the shunt tube 31. The shunt tube 31 is provided with an air intake groove 310 in communication with the air intake hole 910, and an air outlet groove 312 isolated from the air intake groove 310 and in communication with the mouthpiece assembly 10. One end of the air intake pipe 32 is connected to the shunt tube 31, and the opposite end of the air intake pipe 32 extends through the air adjusting inner ring 91 in the axial direction of the atomizing head 50 and to the bottom of the atomizing chamber 5210. The air intake pipe 32 is provided with an air intake pipe 32 in communication with the air intake groove 310 and the bottom of the atomizing chamber 5210. The gap between the inner cavity wall of the atomizing chamber 5210 and the air intake pipe 32, and the gap between the air adjusting inner ring 91 and the air intake pipe 32 form an air outlet passage 323 which communicates between the bottom of the atomizing chamber 5210 and the air outlet groove 312.

Specifically, the shunt tube 31 is substantially T-shaped, the shunt tube 31 includes a splitting portion 314 extending radially along the atomizer 100 and a connecting member 316. The connecting member 316 having a hollow structure extends axially along the atomizer 100. The splitting portion 314 is disposed in the air adjusting inner ring 91 radially along the atomizer 100, the splitting portion 314 is provided with a sealing groove 3141 in the circumferential direction of the air adjusting inner ring 91 toward the side edge of the air adjusting inner ring 91. The connecting member 316 extends through the bottom of the splitting portion 314 to connect with the top portion of the splitting portion 314. The air intake groove 310 extends through the splitting portion 314 and the connecting member 316 along the radial direction of the atomizer 100. Thereby, when the external air enters the air intake hole 910 through the air adjusting groove 930, it flows directly into the connecting member 316 through the air intake groove 310. The seal can prevent the external air that enters the air intake hole 910 through the air adjusting groove 930 and flows along the axial direction of the atomizer 100 from being displaced from the air intake groove 310. The air outlet groove 312 is disposed between the bottom portion and the top portion of the splitting portion 314 along the axial direction of the atomizer 100 and is isolated from the air intake groove 310.

It can be understood that, in other embodiments, the air regulating assembly 90 can be omitted, the external air is directly passing through the shunt tube 31, which is not limited herein.

The air intake pipe 32 is substantially tubular with two open ends. The top end of the air intake pipe 32 is screwed onto the connecting member 316, the bottom end of the air intake pipe 32 passes through the end of the air adjusting inner ring 91 away from the mouthpiece connector 13 and extends to the bottom of the atomizing chamber 5210 axially along the atomizing head 50. The gap between the inner cavity wall of the atomizing chamber 5210 and the air intake pipe 32, and the gap between the air adjusting inner ring 91 and the air intake pipe 32 form the air outlet passage 323.

Figure 5:
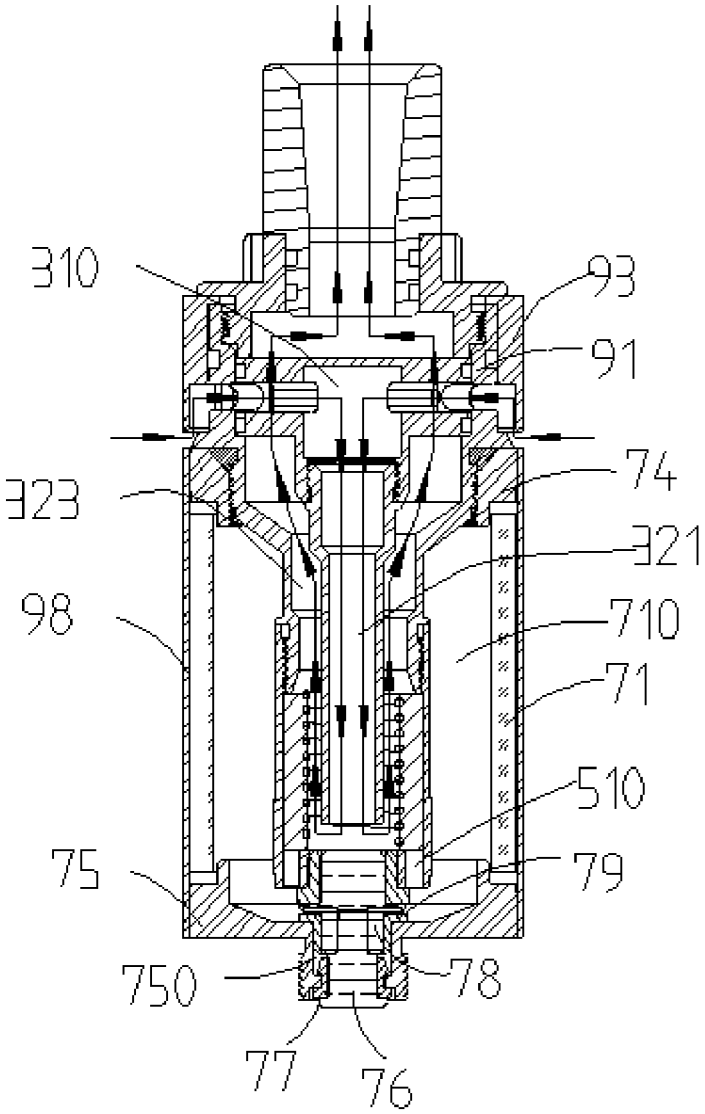
FIG. 5 is a cross-sectional view of the atomizer of FIG. 1 taken along the line A-A.

With continued reference to FIG. 5, the liquid storage assembly 70 includes a liquid storage tube 71 for storing cigarette liquid, a connection seat 74, and an atomizer base 75. The liquid storage tube 71 is substantially tubular with two open ends, the connection seat 74 is connected to the top portion of the liquid storage tube 71 and is screwed to the outer circumference of the air adjusting inner ring 91. The atomizer base 75 is disposed at the bottom of the liquid storage tube 71. When the cigarette liquid injection is required, the screw connection between the air adjusting inner ring 91 and the connection seat 74 is unscrewed, the air adjusting inner ring 91 and the atomizing head 50 are entirely disassembled from the liquid storage tube 71 and the liquid storage tube 71 is exposed.

Figure 6:
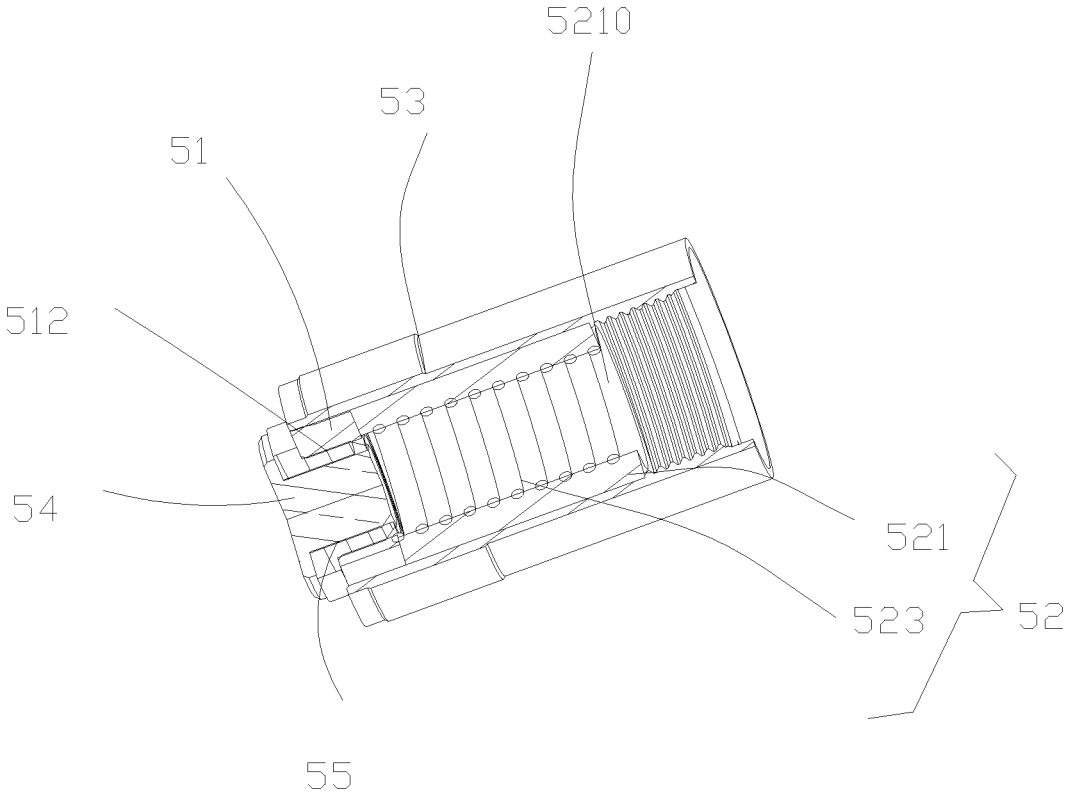
FIG. 6 is a cross-sectional view of the atomizing head shown in FIG. 3 taken along the axial direction.

Referring to FIG. 6, the atomizing head 50 includes an atomizing head base 51, an atomizing assembly 52, and an atomizing head sleeve 53. The atomizing head base 51 is received in the liquid storage tube 71 and is located on the atomizer base 75. The atomizing head sleeve 53 is sleeved on the atomizing head base 51 and is connected at one end of the air adjusting inner ring 91 away from the mouthpiece connector 13. The atomizing assembly 52 is disposed on the atomizing head base 51 and housed in the atomizing head sleeve 53 to atomize the cigarette liquid guided thereto under electric driving.

Specifically, the atomizing assembly 52 includes a liquid guiding member 521 and a heating member 523. The liquid guiding member 521 is disposed on the atomizing head base 51 and housed in the atomizing head sleeve 53. The atomizing head base 51 is provided with a liquid inlet groove 510 in communication with the liquid storage tube 71 and the liquid guiding member 521. The liquid guiding member 521 passes through the opposite ends thereof to form an atomizing chamber 5210. That is, the atomizing chamber 5210 is defined within the liquid guiding member 521 and extends through the axial direction of the liquid guiding member 521. The heating member 523 adheres to the wall of the atomizing chamber 5210.

Referring to FIG. 5 and FIG. 6, in the embodiment, a first electrode 76 and a second electrode 54 are respectively disposed on the liquid storage assembly 70 and the atomizing head 50. Specifically, the first electrode 76 is disposed on the atomizer base 75, and the second electrode 54 is disposed on the atomizing head base 51, the first electrode 76 and the second electrode 54 are electrically connected each other.

Specifically, the atomizer base 75 is provided with a first through hole 750, the first electrode 76 passes through the first through hole 750. In order not to damage the sealing effect of the liquid storage assembly 70, the first electrode 76 and the first through hole 750 are interference fitted. The first electrode 76 and the first through hole 750 can be connected by threaded. In order to further improve the sealing effect, when the first electrode 76 and the first through hole 750 are interference fitted, a first sealing member 77 can be further located therebetween. In one embodiment, the first sealing member 77 is made of silica gel or rubber gasket.

Further, the liquid storage assembly 70 further includes a first electrode contact sleeve 78 and a first silicone gasket 79. The first electrode contact sleeve 78 is sleeved in the first silicone gasket 79 and is latched into one end of the first through hole 750 opposing to the first electrode 76 via the first silicone gasket 79. Specifically, after the first electrode 76 passes through the first through hole 750, the first electrode contact sleeve 78 is latched into the first through hole 750 through the first silicone gasket 79, such that the first electrode 76 can be inserted into the first electrode contact sleeve 78, and then the first electrode 76 and the first electrode contact sleeve 78 contacts with each other to achieve electrical conduction. Further, the first electrode contact sleeve 78 and the first silicone gasket 79 makes the sealing effect between the first electrode 76 and the first through hole 750 better.

The atomizing head base 51 is provided with a second through hole 512, the second electrode 54 passes through the second through hole 512 and is fixedly connected to the atomizing head base 51. Similar to the manner in which the first through hole 750 and the first electrode 76 are assembled, a second sealing member 55 can be disposed between the second electrode 54 and the second through hole 512 to improve the reliability of the seal, and avoid excessive cigarette liquid entering the atomizing head 50 and users taking some un-atomized liquid smoke, affecting the user's taste.

Further, the atomizer 100 includes a protective sleeve 98 sleeved on the outer side of the connection seat 74 and the liquid storage tube 71. The protective sleeve 98 is provided with a window 981 for observing the remaining amount of the cigarette liquid in the liquid storage tube 71 (shown in FIG. 1).

Referring to FIG. 5, in use, the air adjusting outer ring 93 is rotated to adjust the communication area between the air adjusting groove 930 and the air intake hole 910 as needed to adjust the amount of intake air. The external air enters the air intake groove 310 via the air intake hole 910, and is directly guided to the bottom of the atomizing chamber 5210 via the air intake pipe 32 under the guidance of the connecting member 316; and then flows out from the bottom of the atomizing head 50 to the top portion to the air outlet groove 312 via the air outlet passage 323; finally, flows into the mouth of the occupant through the mouthpiece connector 13 and the mouthpiece 11 successively. Since the external air flows through the bottom of the atomizing chamber 5210 and then flows to the top of the atomizing chamber 5210, the smoke in the atomizing chamber 5210 can be mixed with and carried out by the air, thereby effectively avoid the formation of effusion formed by smoke being cooled, after the atomizer 100 is stopped.

On the other hand, the external air is directly passed through the bottom of the atomizing chamber 5210, the bottom of the atomizing chamber 5210 can be cooled to reduce the temperature difference between the top and the bottom of the atomizing head 50. Thus, the following phenomenon can be avoided, when the atomizing head 50 is stopped using, the temperature of the bottom of the atomizing head 50 is too higher than the temperature of the bottom of the atomizing head 50, the rapid cooling will make the pressure at the bottom of the atomizing chamber 5210 suddenly reduced, thereby the cigarette liquid absorbed on the liquid guiding member 521 penetrates to the bottom of the atomizing chamber 5210 to form effusion.

The Second Embodiment

Figure 7:
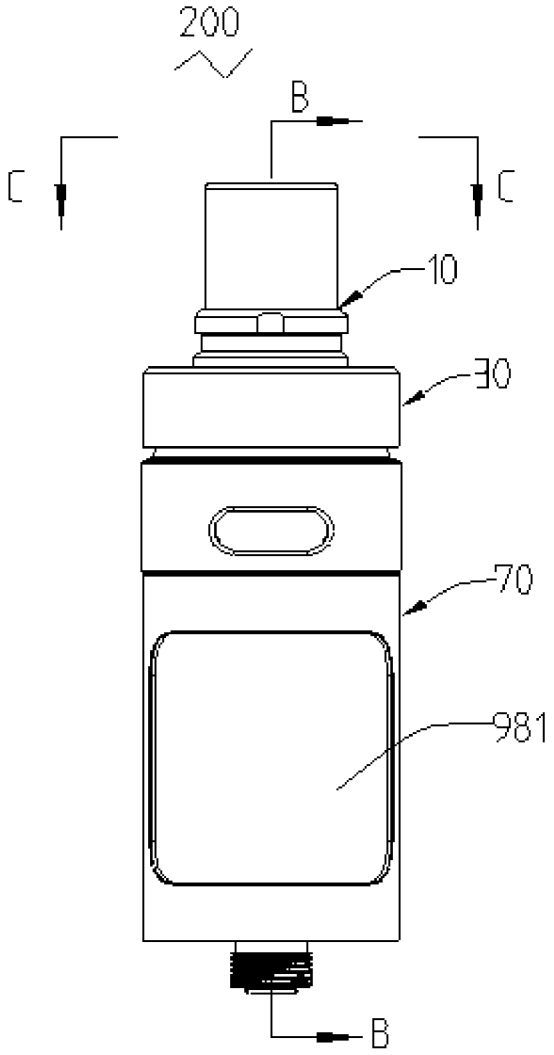
FIG. 7 is a schematic structural view of an atomizer according to a second embodiment of the present disclosure.
Figure 8:
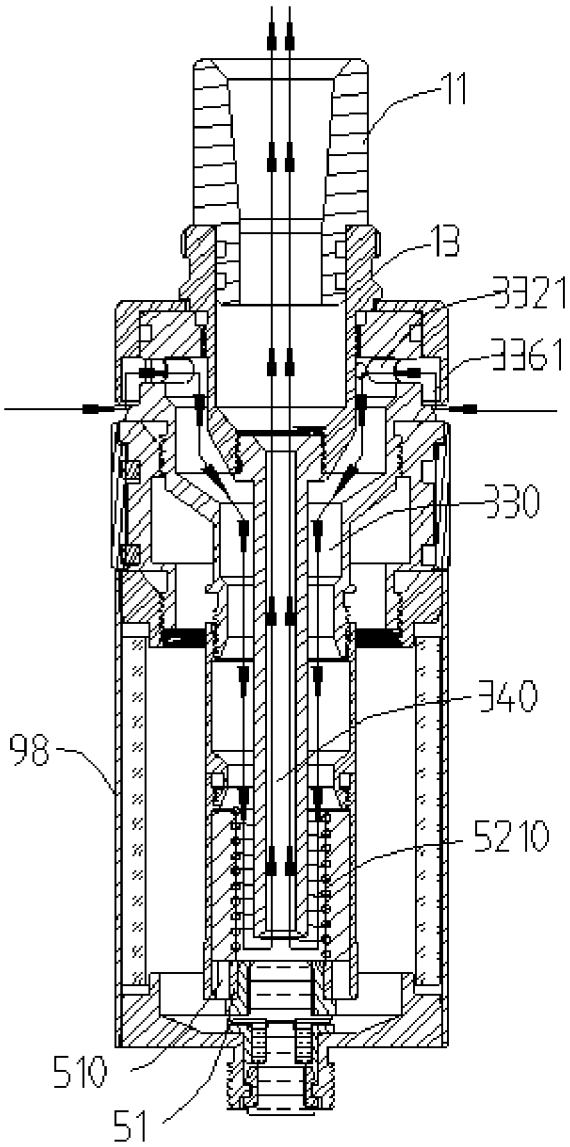
FIG. 8 is a cross-sectional view of the atomizer of FIG. 7 taken along the line B-B.

Referring to FIGS. 7 and 8, a second embodiment of the present disclosure provides an electronic cigarette, the electronic cigarette includes an atomizer 200, and a battery assembly (not shown) electrically connected the atomizer 200. Atomizer 200 includes a mouthpiece assembly 10, an inlet and outlet assembly 30, an atomizing head 50 provided with an atomizing chamber 5210, and a liquid storage assembly 70. The inlet and outlet assembly 30 is connected to the liquid storage assembly 70, a portion of the inlet and outlet assembly 30 is received in the liquid storage assembly 70. The mouthpiece assembly 10 is located at one end of the inlet and outlet assembly 30 away from the liquid storage assembly 70. The atomizing head 50 is housed in the liquid storage assembly 70 and is connected to the opposite end of the inlet and outlet assembly 30 away from the mouthpiece assembly 10. In use, the external air enters the atomizing head 50 through the inlet and outlet assembly 30, and is fully mixed with the smoke formed in an atomizing chamber 5210 defined in the atomizing head 50, and then flows out of the mouthpiece assembly 10 and is sucked into the mouth of the user under the suction of the user.

Figure 9:
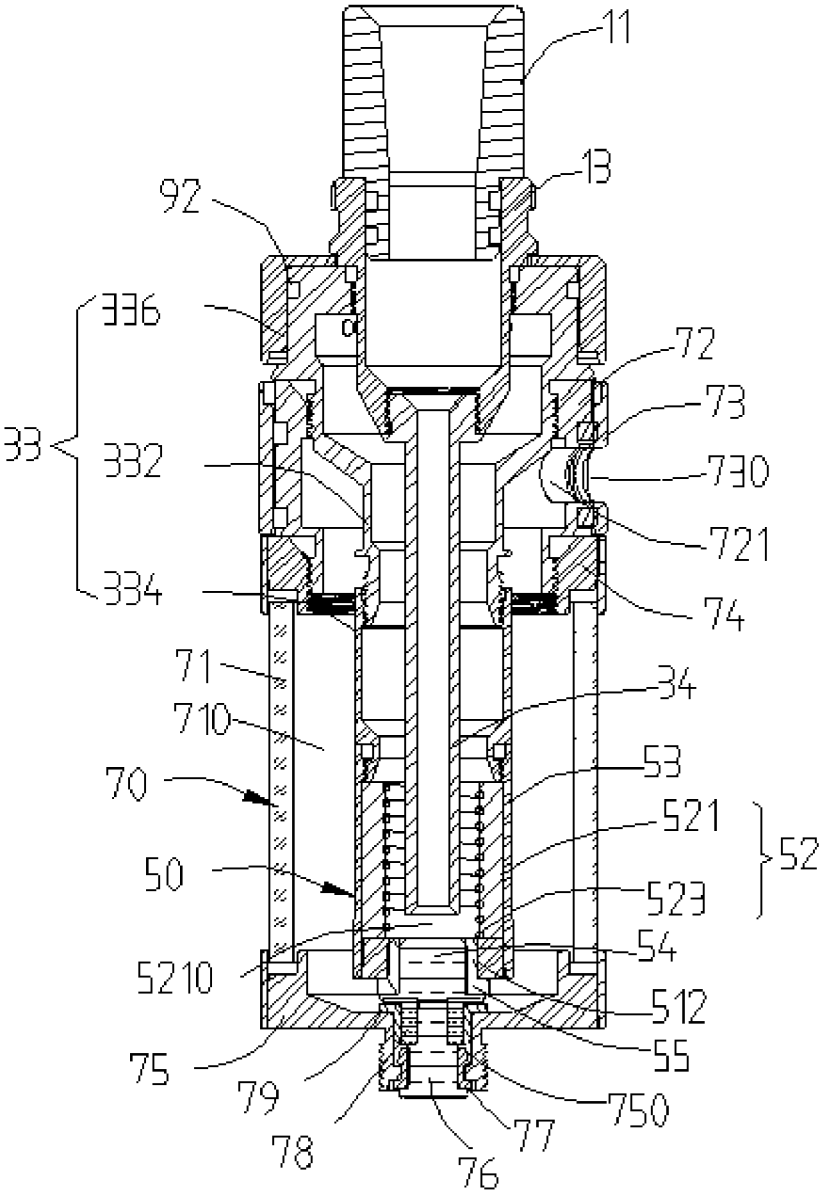
FIG. 9 is a cross-sectional view of the atomizer of FIG. 7 taken along the line C-C.

Referring to FIG. 8 and FIG. 9, the mouthpiece assembly 10 includes a mouthpiece connector 13 and a mouthpiece 11 disposed on the top of the mouthpiece connector 13 for the user to smoke. The inlet and outlet assembly 30 includes an air intake member 33 and an air outlet pipe 34. One end of the air intake member 33 is connected to the atomizing head 50, the air intake member 33 is provided with an air intake passage 330 in communication with the atomizing chamber 5210. One end of the air outlet pipe 34 extends through at least a portion of the air intake passage 330 to the bottom of the atomizing chamber 5210, the air outlet pipe 34 is provided with an air outlet passage 340. The air intake passage 330 is communication with the air outlet passage 340 at the bottom of the atomizing chamber 5210. Such that the external air must flow to the bottom of the atomizing chamber 5210 and mix with the smoke at the bottom of the atomizing chamber 5210, and then flow out to the mouthpiece 11 through the air outlet passage 340 for the user to smoke. The smoke in the atomizing chamber 5210 can be mixed with and carried out by the air, thereby effectively avoid the formation of effusion formed by smoke being cooled, after the atomizer 100 is stopped.

Specifically, the air intake member 33 is substantially tubular with two open ends, one end of the air intake member 33 is threaded on the outer circumference of the mouthpiece connector 13, the opposite end of the air intake member 33 is inserted into the reservoir chamber 710. One end of the air outlet pipe 34 is connected to the mouthpiece connector 13, the opposite end of the air outlet pipe 34 is extended through the air intake member 33 to the bottom of the atomizing chamber 5210. The gap between the air intake member 33 and the mouthpiece connector 13, and the gap between the air intake member 33 and the air outlet pipe 34 form an air intake passage 330 that communicates with the atomizing chamber 5210.

In the present embodiment, the air intake member 33 includes an air intake inner ring 332, a connecting pipe 334, and an air adjusting outer ring 336. The air intake inner ring 332 is sleeved on the outer circumference of the mouthpiece connector 13 and has an air intake hole 3321 in communication with the air intake passage 330. The connecting pipe 334 is connected between the air intake inner ring 332 and the atomizing head 50. The air adjusting outer ring 336 is rotatably sleeved outside of the air intake inner ring 332 and has an air adjusting groove 3361 on its inner wall. The air adjusting groove 3361 extends along the axial direction of the air adjusting outer ring 336 to the bottom edge thereof and is in communication with the outside. When the air adjusting outer ring 336 is rotated, the air adjusting groove 3361 is in commutation with or staggered with the air intake hole 3321, which is convenient for the user to adjust the amount of intake air as needed. In addition, since the air adjusting groove 3361 is defined on the inner wall of the air adjusting outer ring 336, the possibility that the air adjusting groove 3361 is contaminated by the outside can be reduced, and the appearance is beautiful.

The air outlet pipe 34 has a tubular shape with two ends extending therethrough, an air outlet passage 340 is defined in the air outlet pipe 34. The top end of the air outlet pipe 34 is screwed to one end of the mouthpiece connector 13 away from the mouthpiece 11, the bottom end of the air outlet pipe 34 is directly extended through the air intake inner ring 332 and the connecting pipe 334 to the bottom of the atomizing chamber 5210.

It can be understood that, in one embodiment, the air intake inner ring 332 and the connecting pipe 334 can be integrally disposed, or the connecting pipe 334 may be omitted, and the atomizing head 50 can be directly connected to the air intake inner ring 332, there is no limitation here.

The liquid storage assembly 70 includes a liquid storage tube 71 for storing the liquid smoke, a liquid injection inner ring 72, a liquid injection outer ring 73, a connection seat 74, and an atomizer base 75. The liquid storage tube 71 is disposed on the atomizer base 75, the connection seat 74 is disposed on one end of the liquid storage tube 71 away from the atomizer base 75. The liquid injection inner ring 72 is sleeved on the outer circumference of the air intake inner ring 332 and is connected to the connection seat 74. The liquid injection outer ring 73 is rotatably sleeved outside the liquid injection inner ring 72. The liquid injection inner ring 72 is provided with a first liquid injection hole 721 in communication with the inner cavity of the liquid storage tube 71, the liquid injection outer ring 73 is provided with a second liquid injection hole 730 which is in communication with or staggered from the first liquid injection hole 721. When the liquid injection outer ring 73 is rotated to make the second liquid injection hole 730 in communication with the first liquid injection hole 721, the user can inject the cigarette liquid into the liquid storage tube 71 according to the remaining amount of the liquid smoke in the liquid storage tube 71. After the injection is completed, the liquid injection outer ring 73 is rotated to make the first liquid injection hole 721 staggered from the second liquid injection hole 730 to close the liquid storage tube 71. In this embodiment, the connection seat 74 is a collar with internal threads, the liquid injection inner ring 72 of the liquid injection is also provided with threads corresponding to the internal threads of the connection seat 74, so that the liquid injection inner ring 72 of the liquid injection is firmly and sealingly fixed to the connection seat 74.

The atomizing head 50 includes an atomizing head base 51, an atomizing assembly 52, and an atomizing head sleeve 53. The atomizing head base 51 is received in the liquid storage tube 71 and located at the bottom of the liquid storage tube 71. The atomizing head sleeve 53 is sleeved on the atomizing head base 51 and connected to one end of the air intake member 33. The atomizing assembly 52 is disposed on the atomizing head base 51 and housed in the atomizing head sleeve 53 to atomize the liquid smoke guided thereto under electric driving.

Specifically, the atomizing head sleeve 53 is sleeved on the atomizing head base 51 and is connected to one end of the connecting pipe 334 away from the air intake inner ring 332. The atomizing assembly 52 includes a liquid guiding member 521 and a heating member 523. The liquid guiding member 521 is disposed on the atomizing head base 51 and housed in the atomizing head sleeve 53. The atomizing head base 51 is provided with a liquid inlet groove 510 that communicates with the liquid storage tube 71 and the liquid guiding member 521. The opposite ends of the liquid guiding member 521 pass through the axial direction of the liquid guiding member 521 to form an atomizing chamber 5210. The heating member 523 adheres to the wall of the atomizing chamber 5210.

In the embodiment, the first electrode 76 and the second electrode 54 are respectively disposed on the liquid storage assembly 70 and the atomizing head 50. The first electrode 76 is disposed on the atomizer base 75, the second electrode 54 is disposed on the atomizing head base 51, and the two are electrically connected.

Specifically, the atomizer base 75 is provided with a first through hole 750, the first electrode 76 passes through the first through hole 750. In order not to damage the sealing effect of the liquid storage assembly 70, the first electrode 76 and the first through hole 750 are interference fitted. Or, the first electrode 76 and the first through hole 750 can be connected by threaded. In order to further improve the sealing effect, when the first electrode 76 and the first through hole 750 are interference fitted, a first sealing member 77 can be further located therebetween. In one embodiment, the first sealing member 77 is made of silica gel or rubber gasket.

Further, the liquid storage assembly 70 further includes a first electrode contact sleeve 78 and a first silicone gasket 79. The first electrode contact sleeve 78 is sleeved in the first silicone gasket 79 and is latched into one end of the first through hole 750 opposing to the first electrode 76 via the first silicone gasket 79. Specifically, the first electrode 76 passes through the first through hole 750, the first electrode contact sleeve 78 is latched into the first through hole 750 through the first silicone gasket 79, such that the first electrode 76 can be inserted into the first electrode contact sleeve 78, and then the first electrode 76 and the first electrode contact sleeve 78 contacts with each other to achieve electrical conduction. Further, the first electrode contact sleeve 78 and the first silicone gasket 79 provides a sealing between the first electrode 76 and the first through hole 750 better.

The atomizing head base 51 is provided with a second through hole 512, the second electrode 54 passes through the second through hole 512 and is fixedly connected to the atomizing head base 51. Similar to the manner in which the first through hole 750 and the first electrode 76 are assembled, a second sealing member 55 can be disposed between the second electrode 54 and the second through hole 512 to improve the reliability of the seal, and avoid excessive cigarette liquid entering the atomizing head 50 and users taking some un-atomized liquid smoke, affecting the user's taste Further, the atomizer 200 includes a protective sleeve 98 sleeved on the outer side of the connection seat 74 and the liquid storage tube 71. The protective sleeve 98 is provided with a window 981 for observing the remaining amount of the cigarette liquid in the liquid storage tube 71 (shown in FIG. 7).

Further, a third sealing member 92 is provided between the mouthpiece 11 and the mouthpiece connector 13, between the air intake inner ring 332 and the mouthpiece connector 13, between the end of the air adjusting outer ring 336 away from the air adjusting groove 3361 and the air intake inner ring 332, between the liquid injection inner ring 72 and the liquid injection outer ring 73, between the connecting pipe 334 and the atomizing head sleeve 53, between the liquid storage tube 71 and the atomizer base 75, and between the liquid storage tube 71 and the connection seat 74.

Referring to FIG. 5, in use, the air adjusting outer ring 336 is rotated to adjust the communication area between the air adjusting groove 3361 and the air intake hole 3321 as needed to adjust the amount of intake air. The external air first enters the air intake passage 330 located between the air intake inner ring 332, the mouthpiece connector 13 and the air outlet pipe 34 via the air intake hole 3321, and then flows out of the bottom of the atomizing chamber 5210 to the top portion to the air outlet groove 312, and fully mixed with the smoke in the atomizer 200 during the flow. Since the air outlet pipe 34 directly extends to the bottom of the atomizing chamber 5210, the external air must flow to the bottom of the atomizing chamber 5210 and is mixed with the smoke at the bottom of the atomizing chamber 5210 before entering the air outlet pipe 34 through the end opening of the air outlet pipe 34, finally the mixed air passes through the air outlet passage 340 and flows out to the mouthpiece 11 for the user to smoke. Thereby, it can effectively avoid the formation of effusion formed by smoke being cooled after the atomizer 100 is stopped.

In this embodiment, the air outlet pipe 34 of the atomizer 200 extends directly to the bottom of the atomizing chamber 5210. The air intake passage 330 formed between the air intake member 33, the mouthpiece connector 13 and the air outlet pipe 34 is in communication with the air outlet passage 340 of the air outlet pipe 34 at the bottom of the atomizing chamber 5210. Such that the external air flowed into the atomizing chamber 5210 via the air intake member 33 must pass through the bottom portion of the atomizing chamber 5210 before flowing out of the air outlet pipe 34. Thereby, the smoke at the top of the atomizing chamber 5210 or at the bottom of the atomizing chamber 5210 can be mixed with the external air and is taken away by the external air, which can effectively prevent the smoke at the bottom of the atomizing chamber 5210, which didn't carried out by the external air, forming effusion caused by cooling after the atomizer 100 is stopped atomizing.

The Third Embodiment

Figure 10:
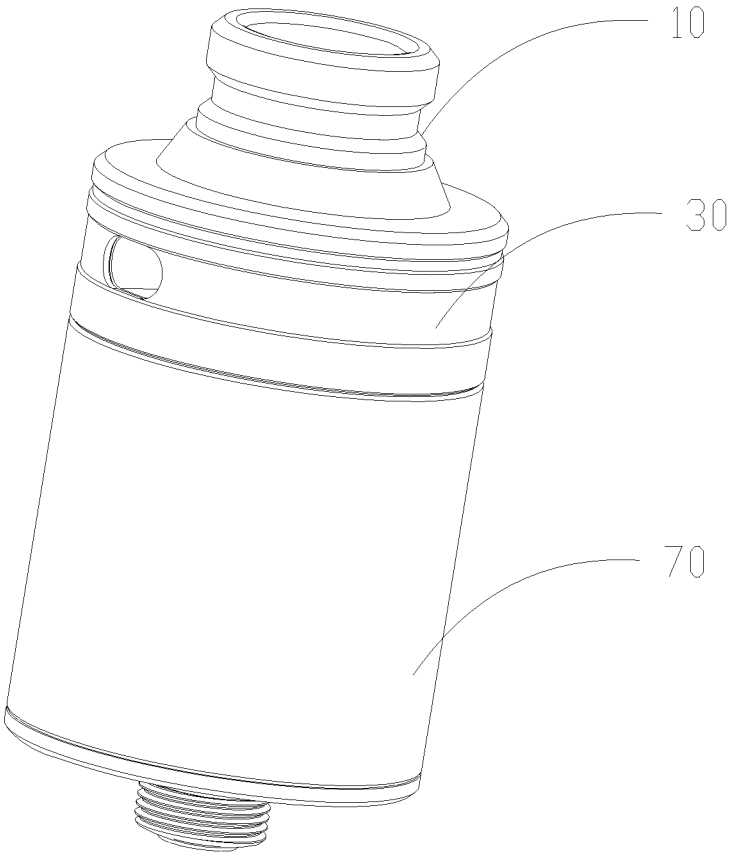
FIG. 10 is a schematic structural view of an atomizer according to a third embodiment of the present disclosure.
Figure 11:
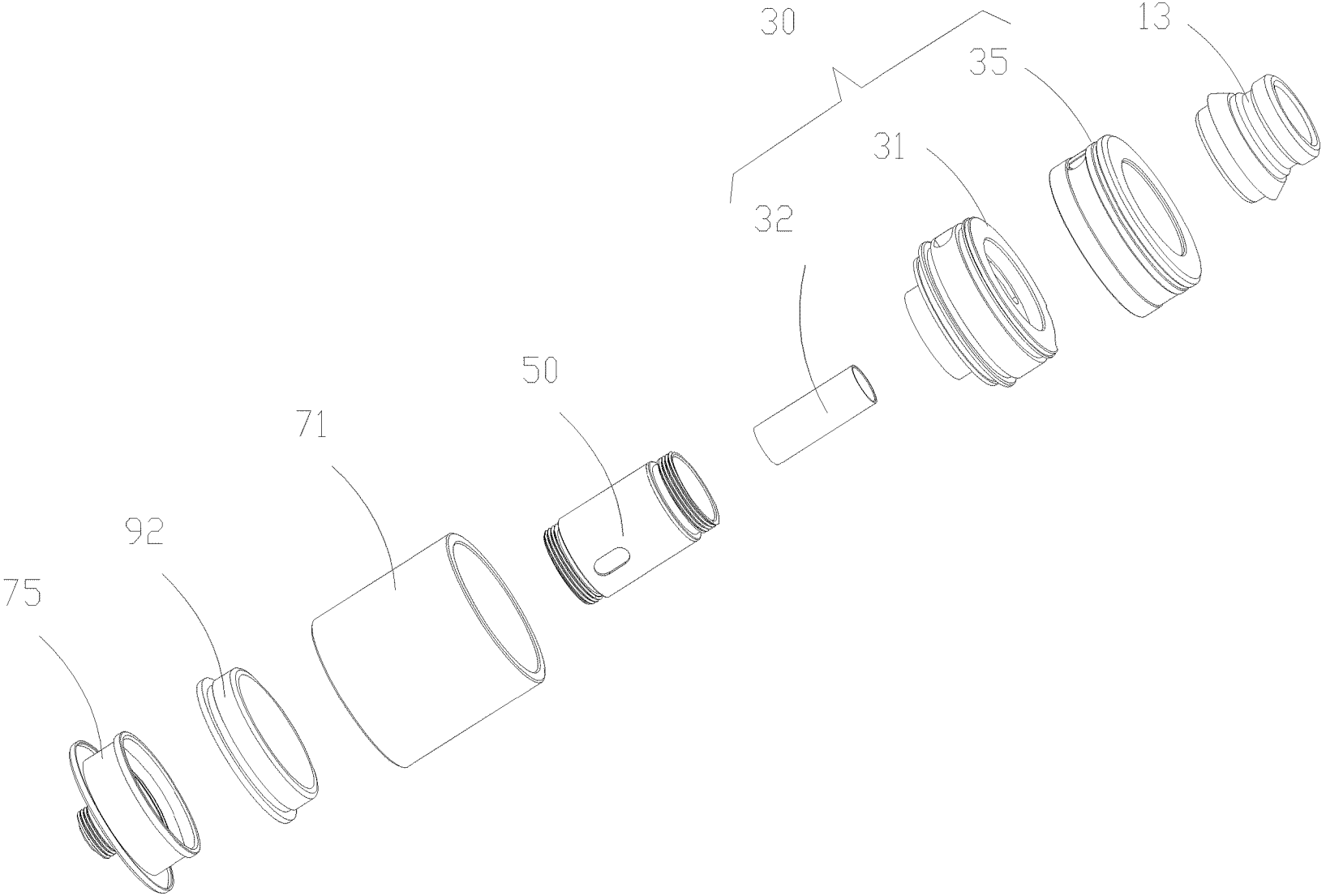
FIG. 11 is an exploded perspective view of the atomizer of FIG. 10.
Figure 12:
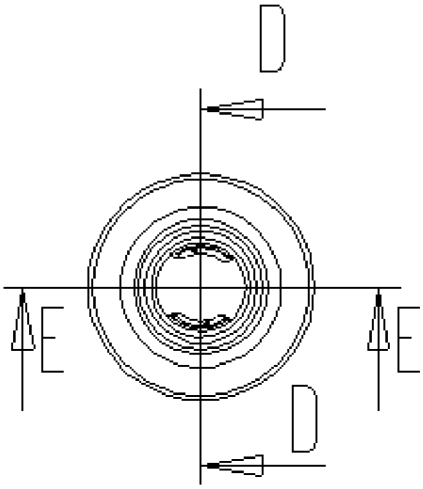
FIG. 12 is a top view of the atomizer shown in FIG. 10.
Figure 13:
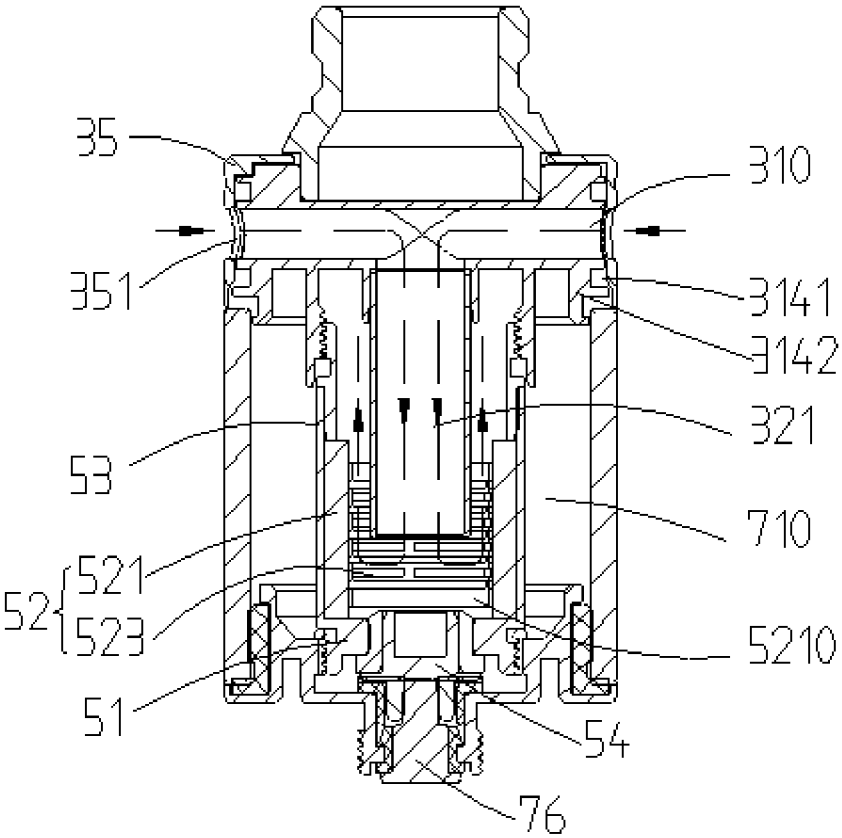
FIG. 13 is a cross-sectional view of the atomizer of FIG. 12 taken along the line D-D.

Referring to FIGS. 10, 11 and 13, a third embodiment of the present disclosure provides an electronic cigarette, the electronic cigarette includes an atomizer 300, and a battery assembly (not shown) electrically connected the atomizer 300. Atomizer 300 includes a mouthpiece assembly 10, an inlet and outlet assembly 30, an atomizing head 50 provided with an atomizing chamber 5210, and a liquid storage assembly 70 provided with a liquid a reservoir chamber 710. The inlet and outlet assembly 30 is connected to the liquid storage assembly 70, a portion of the inlet and outlet assembly 30 is housed in the liquid storage assembly 70. The mouthpiece assembly 10 is located at one end of the inlet and outlet assembly 30 away from the liquid storage assembly 70. The atomizing head 50 is received in liquid storage assembly 70 and is connected with one end of the inlet and outlet assembly 30 away from the liquid storage assembly 70. In use, the external air passes through the inlet and outlet assembly 30 and flows into atomizing head 50, and is fully mixed with the smoke formed by the atomizer 100, then the mixed smoke flows out of the mouthpiece assembly 10 and is sucked into the mouth of the user under the suction of the user.

Figure 14:
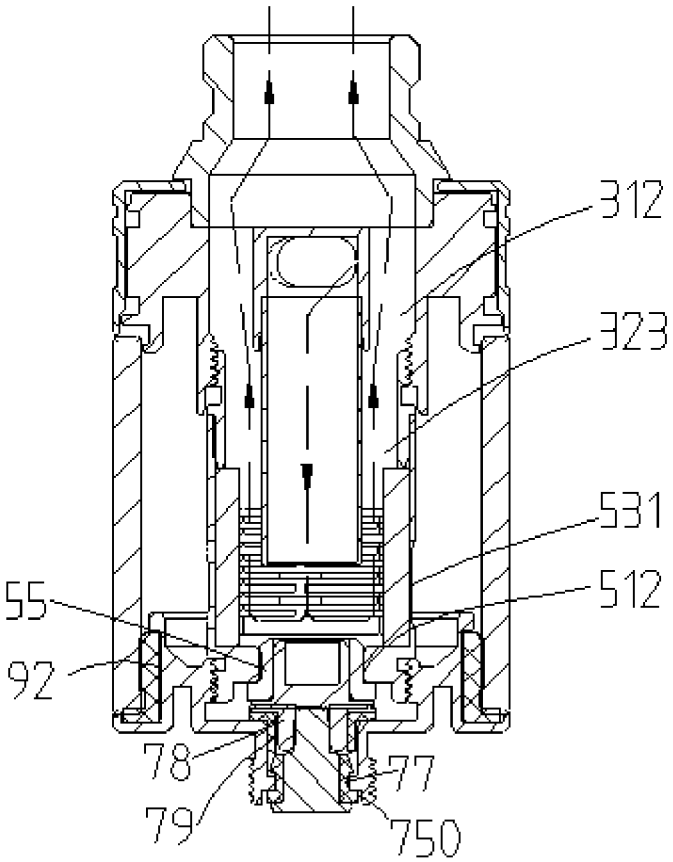
FIG. 14 is a cross-sectional view of the atomizer of FIG. 12 taken along the line E-E.

Referring to FIGS. 11, 13 and 14, the mouthpiece assembly 10 includes a mouthpiece connector 13 and a mouthpiece (not shown) disposed on the top of the mouthpiece connector 13 for the user to smoke. The inlet and outlet assembly 30 include a shunt tube 31 and an air intake pipe 32. One end of the shunt tube 31 is connected to the mouthpiece connector 13, the opposite end of the shunt tube 31. The shunt tube 31 defines an air intake groove 310 and an air outlet groove 312, the air outlet groove 312 is isolated from the air intake groove 310 and in communication with the mouthpiece assembly 10. One end of the air intake pipe 32 is connected to the shunt tube 31, the opposite end of the air intake pipe 32 extends axially through the shunt tube 31 along the atomizing head 50 and to the bottom of the atomizing chamber 5210. The air intake pipe 32 defines an air intake passage 321 in communication with the air intake groove 310 and the bottom of the atomizing chamber 5210. The gap between the inner cavity wall of the atomizing chamber 5210 and the air intake pipe 32 forms an air outlet passage 323, which communicates between the bottom of the atomizing chamber 5210 and the air outlet groove 312.

Figure 15:
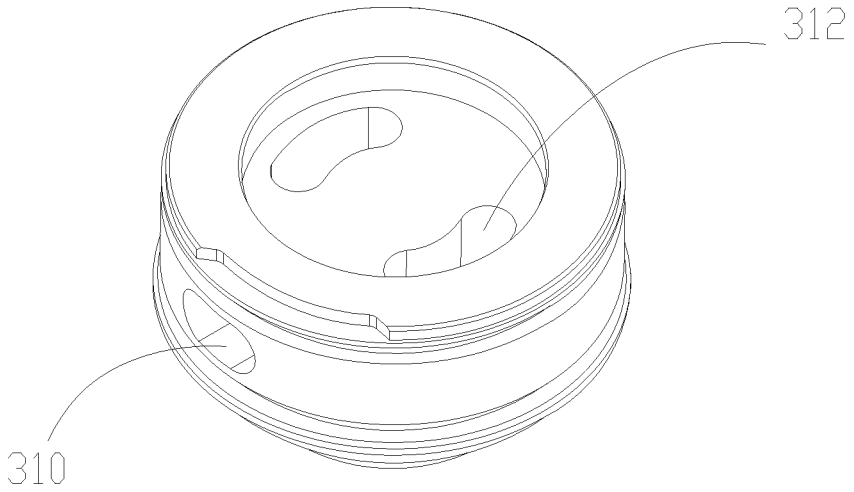
FIG. 15 is a perspective view of the shunt tube of the atomizer of FIG. 11.
Figure 16:
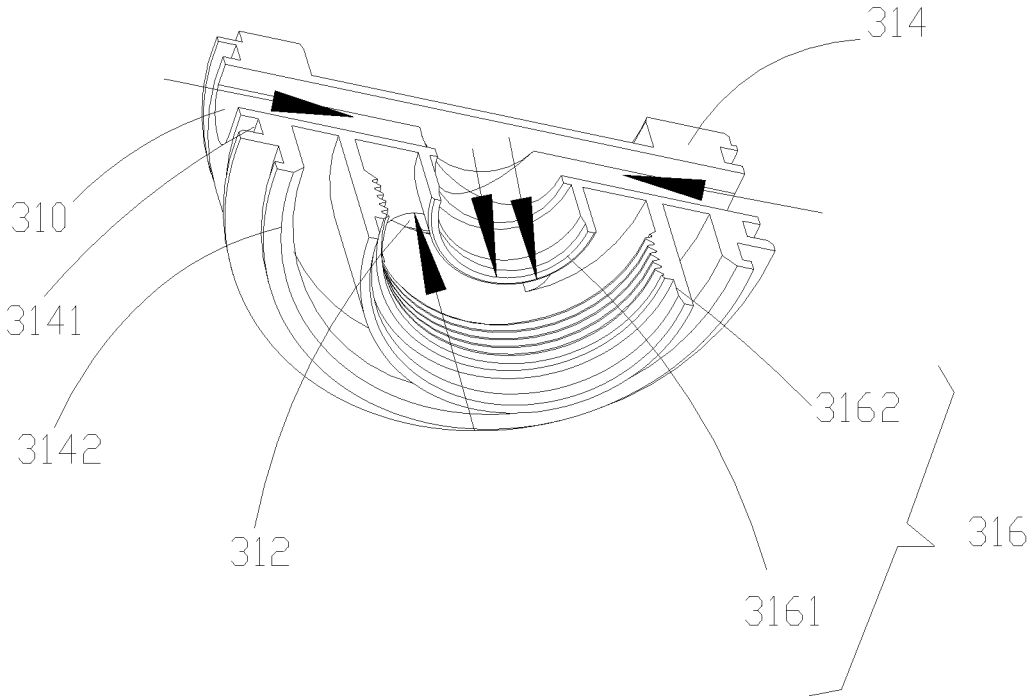
FIG. 16 is a cross-sectional view of the shunt tube of FIG. 15 taken along the axial direction.

Referring to FIGS. 15 and 16, specifically, the shunt tube 31 is substantially T-shaped, the shunt tube 31 includes a splitting portion 314 and a connecting member 316 extending axially along the atomizer 100. The side edge of the splitting portion 314 defines a sealing groove 3141 along in the circumferential direction of the splitting portion 314, the bottom of the splitting portion 314 extends downward in the axial direction of the atomizer 100 to form a socket portion 3142. The air intake groove 310 passes through two opposite ends of the splitting portion 314 in the radial direction of the atomizer 100. The connecting member 316 includes a first connecting portion 3161 and a second connecting portion 3162 for connecting with the atomizing head 50. The first connecting portion 3161 extends the bottom of the splitting portion 314 and is in communication with the air intake groove 310. The second connecting portion 3162 is disposed between the first connecting portion 3161 and the socket portion 3142. The air outlet groove 312 extends through the bottom and the top of the splitting portion 314 in the axial direction of the atomizer 100, the air outlet groove 312 is located between the first connecting portion 3161 and the second connecting portion 3162 and is isolated from the air intake groove 310. A sealing ring (not shown) is latched in the sealing groove 3141 to prevent the external air from flowing axially along the atomizer 300 and staggering the air intake groove 310.

The air intake pipe 32 is substantially tubular with two open ends, the top end of which is inserted into the first connecting portion 3161, the bottom end passes through the second connecting portion 3162 and extends axially along the atomizing head 50 to the atomizing chamber 5210 bottom.

Referring again to FIGS. 13 and 14, the inlet and outlet assembly 30 further includes an air regulating ring 35. The air regulating ring 35 is rotatably sleeved outside the shunt tube 31, the air regulating ring 35 is provided with an air vent 351 corresponding to the air intake groove 310. The user can rotate the air regulating ring 35 to adjust the communication area of the air vent 351 and the air intake groove 310, thereby adjusting the amount of intake air. When the air vent 351 is straggled from the air intake groove 310, the air intake groove 310 is closed.

Referring to FIGS. 11, 13, and 14, the liquid storage assembly 70 includes a liquid storage tube 71 for storing the cigarette liquid and an atomizer base 75. The liquid storage tube 71 is tubular with two open ends, one end of the liquid storage tube 71 is sleeved outside the socket portion 3142, the opposite end of the liquid storage tube 71 is connected with the atomizer base 75. Specifically, the atomizer base 75 blocks one end of the liquid storage tube 71 away from the socket portion 3142. When the injection of the liquid smoke is required, the inlet and outlet assembly 30 and the atomizing head 50 as a whole are disassembled from the liquid storage tube 71, and then the opening of the liquid storage tube 71 is exposed.

Referring to FIGS. 13 and 14, the atomizing head 50 is housed in a liquid storage tube 71. The atomizing head 50 includes an atomizing head base 51, an atomizing assembly 52, and an atomizing head sleeve 53. One end of the atomizing head base 51 is connected to the atomizer base 75, the opposite end of the atomizing head base 51 is connected to the atomizing head sleeve 53. One end of the atomizing head sleeve 53 away from the atomizing head base 51 is connected to the second connecting portion 3162. The atomizing assembly 52 is disposed on the atomizing head base 51 and housed in the atomizing head sleeve 53. In the embodiment, the atomizing head base 51 is integrally formed with the atomizing head sleeve 53.

Specifically, the atomizing assembly 52 includes a liquid guiding member 521 and a heating member 523. The liquid guiding member 521 is disposed on the atomizing head base 51 and housed in the atomizing head sleeve 53. The atomizing head sleeve 53 is provided with a liquid inlet hole 531 in communication with the liquid storage tube 71 and the liquid guiding member 521. The opposite ends of the liquid guiding member 521 extend the axial direction of the liquid guiding member 521 to form an atomizing chamber 5210. The heating member 523 adheres to the wall of the atomizing chamber 5210.

Referring to FIGS. 13 and 14, in the embodiment, the first electrode 76 and the second electrode 54 are respectively disposed on the liquid storage assembly 70 and the atomizing head 50. The first electrode 76 is disposed on the atomizer base 75, and the second electrode 54 is disposed on the atomizing head base 51, the two are electrically connected.

Specifically, the atomizer base 75 is provided with a first through hole 750, the first electrode 76 passes through the first through hole 750. In order not to damage the sealing effect of the liquid storage assembly 70, the first electrode 76 and the first through hole 750 are interference fitted. Or, the first electrode 76 and the first through hole 750 can be connected by threaded. In order to further improve the sealing effect, when the first electrode 76 and the first through hole 750 are interference fitted, a first sealing member 77 can be further disposed therebetween. In one embodiment, the first sealing member 77 is made of silica gel or rubber gasket.

Further, the liquid storage assembly 70 further includes a first electrode contact sleeve 78 and a first silicone gasket 79. The first electrode contact sleeve 78 is sleeved in the first silicone gasket 79 and is latched into one end of the first through hole 750 opposing to the first electrode 76 via the first silicone gasket 79. Specifically, the first electrode 76 passes through the first through hole 750, the first electrode contact sleeve 78 is latched into the first through hole 750 through the first silicone gasket 79, such that the first electrode 76 can be inserted into the first electrode contact sleeve 78, and then the first electrode 76 and the first electrode contact sleeve 78 contact with each other to achieve electrical conduction. Further, the first electrode contact sleeve 78 and the first silicone gasket 79 makes the sealing effect between the first electrode 76 and the first through hole 750 better.

The atomizing head base 51 is provided with a second through hole 512, the second electrode 54 passes through the second through hole 512 and is fixedly connected to the atomizing head base 51. Similar to the manner in which the first through hole 750 and the first electrode 76 are assembled, a second sealing member 55 can be disposed between the second electrode 54 and the second through hole 512 to improve the reliability of the seal, and avoid excessive cigarette liquid entering the atomizing head 50 and users taking some un-atomized liquid smoke, affecting the user's taste Further, a third sealing member 92 is further disposed between the liquid storage tube 71 and the atomizer base 75.

Referring to FIG. 5, in use, the air regulating ring 35 is rotated to adjust the communication area between the air intake groove 310 and the air vent 351 as needed to adjust the amount of intake air. The external air enters the air intake groove 310 via the air vent 351, and is directly guided to the bottom of the atomizing chamber 5210 via the air intake pipe 32 under the guidance of the first connecting portion 3161. And then, the external air flows out from the bottom of the atomizing chamber 5210 to the top portion to the air outlet groove 312 via the air outlet passage 323; finally, flows into the mouth of the user. Since the external air flows through the bottom of the atomizing chamber 5210 and then flows to the top of the atomizing chamber 5210, the smoke in the atomizing chamber 5210 can be mixed with and carried out by the air, thereby effectively avoid the formation of effusion formed by smoke being cooled, after the atomizer 300 is stopped.

On the other hand, the external air is directly passed through the bottom of the atomizing chamber 5210, the bottom of the atomizing chamber 5210 can be cooled to reduce the temperature difference between the top and the bottom of the atomizing head 50. Thus, the following phenomenon can be avoided: when the atomizing head 50 is stopped using, the temperature of the bottom of the atomizing head 50 is much higher than the temperature of the bottom of the atomizing head 50, the rapid cooling will make the pressure at the bottom of the atomizing chamber 5210 suddenly reduced, thereby the cigarette liquid absorbed on the liquid guiding member 521 penetrates to the bottom of the atomizing chamber 5210 to form effusion.

The above-mentioned embodiments merely represent several implementations of the present application, and the descriptions thereof are more specific and detailed, but they shall not be understood as a limitation on the scope of the present application. It should be noted that, for those of ordinary skill in the art, variations and improvements may still be made without departing from the concept of the present application, and all of which shall fall into the protection scope of the present application. Therefore, the scope of protection of the present application shall be subject to the appended claims.

What is claimed is:

1. An atomizer, comprising:

an atomizing head provided with an atomizing chamber; and an inlet and outlet assembly, comprising a shunt tube and an air intake pipe, wherein the shunt tube is provided with an air intake groove and an air outlet groove isolated from the air intake groove, one end of the air intake pipe is connected to the shunt tube, and an opposite end of the air intake pipe extends through an air adjusting inner ring in an axial direction of the atomizing head to a bottom of the atomizing chamber, the air intake pipe is provided with an air intake passage in communication with the air intake groove and the bottom of the atomizing chamber, and a gap between an inner cavity wall of the atomizing chamber and the air intake pipe form an air outlet passage which is in communication with the bottom of the atomizing chamber and the air outlet groove.

2. The atomizer according to claim 1, further comprising an air regulating assembly comprising the air adjusting inner ring and an air adjusting outer ring, wherein one end of the air adjusting inner ring is sleeved on an outer circumference of a mouthpiece connector, an opposite end of the air adjusting inner ring is connected to the atomizing head, the air adjusting inner ring is provided with an air inlet in communication with an air adjusting groove, the air adjusting outer ring is rotatably sleeved outside of the air adjusting inner ring, an inner wall of the air adjusting outer ring is provided with an air adjusting groove in communication with an outside, and rotating the air adjusting outer ring can make the air adjusting groove in communication with or staggered from the air inlet.

3. The atomizer according to claim 2, wherein the shunt tube comprises a splitting portion extending radially along the atomizer and a connecting member extending axially along the atomizer, and wherein the splitting portion is located on a regulating inner ring, the connecting member extends through a bottom portion of the splitting portion to connect with a top portion of the splitting portion, the air intake groove extends through the splitting portion and the connecting member along the radial direction of the atomizer, the air inlet extends through the splitting portion and the connecting member along an axial direction of the atomizer, the air outlet groove is disposed between the bottom portion and the top portion of the splitting portion along the axial direction of the atomizer.

4. The atomizer according to claim 3, wherein the one end of the air intake pipe is connected to the connecting member, the opposite end of the air intake pipe extends through the air adjusting inner ring along the atomizing head to the bottom of the atomizing chamber, the air outlet passage further comprises a gap located between the air adjusting inner ring and the air intake pipe.

5. The atomizer according to claim 1, wherein the shunt tube comprises a splitting portion extending radially along the atomizer and a connecting member extending axially along the atomizer, and wherein the air intake groove extends through opposite ends of the splitting portion, the connecting member comprises a first connecting portion and a second connecting portion sleeved outside of the first connecting portion, the first connecting portion extends through a bottom of the splitting portion and is in communication with the air intake groove, the air outlet groove extends through the bottom and a top of the splitting portion in an axial direction of the atomizer, and the air outlet groove is located between the first connecting portion and the second connecting portion.

6. The atomizer according to claim 5, wherein the one end of the air intake pipe is connected to the shunt tube, the opposite end of the air intake pipe extends through the second connecting portion and to the bottom of the atomizing chamber in the axial direction of the atomizing head, and the atomizing head is connected to the second connecting portion.

7. The atomizer according to claim 3, wherein a side edge of the splitting portion is provided with a sealing groove along a circumferential direction thereof.

8. The atomizer according to claim 1, further comprising a liquid storage assembly comprising a liquid storage tube for storing cigarette liquid, wherein the atomizing head comprises an atomizing head base, an atomizing assembly, and an atomizing head sleeve, and wherein the atomizing head base is received in the liquid storage tube, the atomizing head sleeve is sleeved on the atomizing head base, and the atomizing assembly is located on the atomizing head base and received in the atomizing head sleeve.

9. The atomizer according to claim 8, wherein the atomizing assembly comprises a liquid guiding member and a heating member, wherein the liquid guiding member is disposed on the atomizing head base and housed in the atomizing head sleeve, and the liquid guiding member passes through opposite ends thereof to form the atomizing chamber, wherein the atomizing head base is provided with a liquid inlet groove in communication with the liquid storage tube and the liquid guiding member, or, the atomizing head sleeve is provided with a liquid inlet hole in communication with the liquid storage tube and the liquid guiding member, and wherein the heating member adheres to the wall of the atomizing chamber.

10. The atomizer according to claim 9, wherein the liquid storage assembly comprises an atomizer base, and wherein a first electrode is disposed on the atomizer base, a second electrode is disposed on the atomizing head base, and the first electrode and the second electrode are electrically connected to each other.

11. An electronic cigarette, comprising an atomizer, wherein the atomizer comprises:

an atomizing head provided with an atomizing chamber; and an inlet and outlet assembly comprising a shunt tube and an air intake pipe, wherein the shunt tube is provided with an air intake groove and an air outlet groove isolated from the air intake groove one end of the air intake pipe is connected to the shunt tube, an opposite end of the air intake pipe extends through an air adjusting inner ring in an axial direction of the atomizing head to a bottom of the atomizing chamber, the air intake pipe is provided with an air intake passage in communication with the air intake groove and the bottom of the atomizing chamber, and a gap between an inner cavity wall of the atomizing chamber and the air intake pipe form an air outlet passage which is in communication with the bottom of the atomizing chamber and the air outlet groove.

12. An atomizer, comprising:

an atomizing head provided with an atomizing chamber; and an inlet and outlet assembly comprising an air intake member and an air outlet pipe, wherein one end of the air intake member is connected to the atomizing head, an air intake passage in communication with the atomizing chamber is disposed within the air intake member, an opposite end of the air intake member away from the atomizing head defines an air intake hole in communication with the air intake passage, a bottom end of the air outlet pipe directly extends through the air intake passage to a bottom of the atomizing chamber, the air outlet pipe defines an outlet passage, and the air outlet passage is in communication with the air intake passage at the bottom of the atomizing chamber.

13. The atomizer according to claim 12, further comprising a mouthpiece assembly comprising a mouthpiece connector, wherein one end of the air outlet pipe away from the bottom of the atomizing chamber is connected with the mouthpiece connector, the air intake member is sleeved on an outer circumference of the mouthpiece connector the air intake passage is formed by a gap between the air intake member and the mouthpiece connector, and a gap between the air intake member and the air outlet pipe.

14. The atomizer according to claim 12, wherein the air intake member comprises an air intake inner ring, the air intake hole is defined at a first end of the air intake inner ring, a second end of the air intake inner ring away from the air intake hole is connected to the atomizing head.

15. The atomizer according to claim 12, wherein the air intake member comprises an air intake inner ring and a connecting pipe, the air intake hole is defined at a first end of the air intake inner ring, and the connecting pipe is connected between a second end of the air intake inner ring away from the air intake hole and the atomizing head.

16. The atomizer according to claim 14, wherein the air intake member further comprises an air adjusting outer ring, the air adjusting outer ring is rotatably sleeved outside of the air intake inner ring and has an air adjusting groove defined on an inner wall thereof, and the air adjusting groove in communication with or staggered from an outside.

17. The atomizer according to claim 16, wherein the air adjusting groove extends along an axial direction of the air adjusting outer ring to a bottom edge thereof and is in communication with the outside.

18. The atomizer according to claim 12, further comprising an atomizing assembly, wherein the atomizing assembly comprises a liquid guiding member and a heating member, opposite ends of the liquid guiding member extend in an axial direction of the liquid guiding member to form the atomizing chamber, the heating member adheres to a wall of the atomizing chamber.

19. The atomizer according to claim 18, further comprising a liquid storage assembly, wherein the liquid storage assembly comprises a liquid storage tube for storing cigarette liquid, and wherein the atomizing head further comprises an atomizing head base and an atomizing head sleeve, the atomizing head base is received in the liquid storage tube, the atomizing head sleeve is sleeved on the atomizing head base and connected to the one end of the air intake member, the liquid guiding member and the heating member are received in the atomizing head sleeve, and the atomizing head base is provided with a liquid inlet groove in communication with the liquid storage tube and the liquid guiding member.

20. The atomizer according to claim 19, wherein the liquid storage assembly further comprises a liquid injection outer ring, a liquid injection inner ring and a connection seat, and wherein the liquid injection outer ring is rotatably sleeved outside of the liquid injection inner ring, the connection seat is connected between the liquid injection inner ring and liquid storage tube, the liquid injection inner ring defines a first injection hole in communication with an inner chamber of the liquid storage tube, and the liquid injection outer ring defines a second injection hole in communication with or staggered from the first injection hole.

* * * * *